US008080510B2

(12) United States Patent
Becherer et al.

(10) Patent No.: US 8,080,510 B2
(45) Date of Patent: Dec. 20, 2011

(54) DETERGENT COMPOSITION FOR TEXTILE FIBRE MATERIALS

(75) Inventors: Oliver Becherer, Schwörstadt (DE); Robert Hochberg, Merzhausen (DE); Gerhard Merkle, Freiburg (DE); Bernard Schultz, St. Louis (FR); Purushottam Jugalkishor Chandak, Gujarat (IN)

(73) Assignee: BASF SE, Ludwigshafen (DE)

( * ) Notice: Subject to any disclaimer, the term of this patent is extended or adjusted under 35 U.S.C. 154(b) by 219 days.

(21) Appl. No.: 12/227,041

(22) PCT Filed: May 14, 2007

(86) PCT No.: PCT/EP2007/054623

§ 371 (c)(1),
(2), (4) Date: Nov. 5, 2008

(87) PCT Pub. No.: WO2007/135003

PCT Pub. Date: Nov. 29, 2007

(65) Prior Publication Data

US 2009/0106916 A1 Apr. 30, 2009

(30) Foreign Application Priority Data

May 23, 2006 (EP) ..... 06114362

(51) Int. Cl.
*C11D 17/00* (2006.01)

(52) U.S. Cl. ..... 510/307; 510/311; 510/324; 510/375; 510/376; 510/392

(58) Field of Classification Search ..... None
See application file for complete search history.

(56) References Cited

U.S. PATENT DOCUMENTS

| | | | | |
|---|---|---|---|---|
| 6,248,887 | B1 | 6/2001 | Feldhues et al. | 544/193.2 |
| 2006/0185805 | A1 | 8/2006 | Rohringer et al. | 162/158 |
| 2007/0094814 | A1 | 5/2007 | Zelger et al. | 8/688 |
| 2008/0073617 | A1 | 3/2008 | Cockcrof et al. | 252/301.23 |
| 2008/0191169 | A1 | 8/2008 | Rohringer et al. | 252/301.25 |

FOREIGN PATENT DOCUMENTS

| | | |
|---|---|---|
| GB | 2 076 011 | 1/1981 |
| WO | 97/19937 | 6/1997 |
| WO | 2004/111330 | 12/2004 |
| WO | 2005/149932 | 2/2005 |
| WO | 2005/105469 | 11/2005 |
| WO | 2006/045714 | 5/2006 |

*Primary Examiner* — Necholus Ogden, Jr.
(74) *Attorney, Agent, or Firm* — Shiela A. Loggins

(57) ABSTRACT

A detergent composition comprising i) 1-70% of an anionic or nonionic surfactant, ii) 1-75% of a builder, iii) 0.001-5% of at least one compound of Formula (1) wherein R represents a $C_1$-$C_4$alkyl residue and M represents hydrogen or an alkali metal cation, optionally with further FWA's, iv) 0-30% of a peroxide, v) 0-10% of a peroxide activator, vi) 0-5% of a bleaching catalyst and vii) 0-5% of an enzyme, each component by weight, based on the total weight of the detergent composition, use thereof for domestic washing of textile fibre materials and a process for the fluorescent whitening of textile materials.

(1)

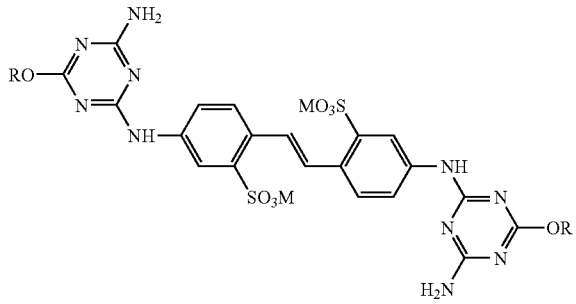

13 Claims, No Drawings

DETERGENT COMPOSITION FOR TEXTILE FIBRE MATERIALS

The present invention relates to a detergent composition for the treatment of textile fibre materials containing certain fluorescent whitening agents or mixtures of fluorescent whitening agents It is commonly known to use fluorescent whitening agents in detergent formulations. They exhaust during the treatment on to the material to be washed and, by virtue of their special light absorption/emission property, result in elimination of the yellowish shades.

However there is still a need to find improved fluorescent whitening agents for this application. It has now been found that the following compounds of formula (1), as well as their mixtures together with compounds of formulae (2) and/or (3), possess superior properties with regard to, for example, solubility, build-up properties, light-fastness, degree of whiteness, and also possess excellent white aspects in the solid state. The whiteness properties, like whiteness maintenance, can even be enhanced by the use of compounds of formula (1) in detergents containing a peroxide, a peroxide activator and/or a bleaching catalyst. Favourable results are even obtained at low washing temperatures.

Accordingly, the present invention provides, as a first aspect, a detergent composition comprising i) 1-70% of an anionic and/or nonionic surfactant,
ii) 1-75% of a builder,
iii) 0.001-5% of at least one compound of the formula (1)

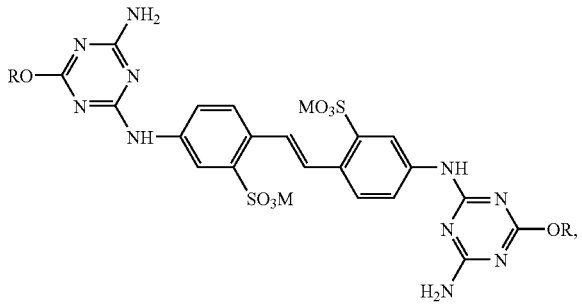

wherein,

R represents a $C_1$-$C_4$alkyl residue, preferably, methyl or ethyl and

M represents hydrogen or an alkali metal cation, most preferably, lithium or sodium, iv) 0-30% of a peroxide,
v) 0-10% of a peroxide activator,
vi) 0-5% of a bleaching catalyst and
vii) 0-5% of an enzyme, each component by weight, based on the total weight of the detergent composition.

More preferably the detergent compositions used comprise i) 5-70% of an anionic surfactant and/or a nonionic surfactant;
ii) 5-70% of a builder;
iii) 0.5-30% of a peroxide;
iv) 0.5-10% of a peroxide activator and/or 0.1-2% of a bleaching catalyst; and
v) 0.01-5% of a mixture of compounds of formulae (1) and (2), each by weight, based on the total weight of the detergent.

In one further aspect, the invention relates to a detergent composition, as defined above, which additionally comprises from 0.001 to 5% by weight of at least one compound of the formula (2)

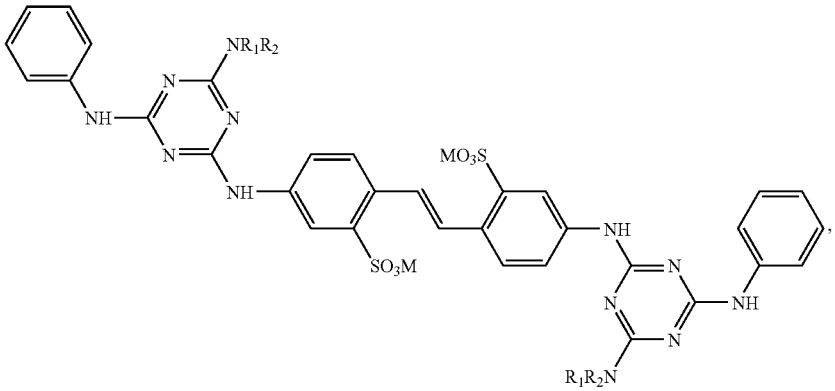

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring.

Preferred compounds of formula (2) are those in which $R_1$ represents hydrogen, methyl, ethyl, hydroxyethyl or hydroxypropyl, $R_2$ represents methyl, ethyl, hydroxyethyl, hydroxypropyl or phenyl, or $R_1$ and $R_2$, together with the nitrogen atom, complete a morpholino ring and M represents hydrogen or sodium, especially sodium.

In a second further aspect, the invention relates to a detergent composition, as defined above, which additionally comprises from 0.001 to 5% by weight of at least one compound of the formula (3)

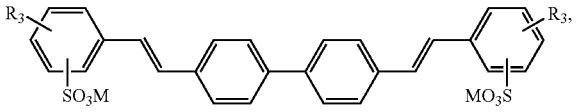

wherein $R_3$ represents hydrogen, $C_1$-$C_4$alkyl, $C_1$-$C_4$alkoxy or halogen.

Preferably, the compound of formula (3) is selected from the compounds of formulae

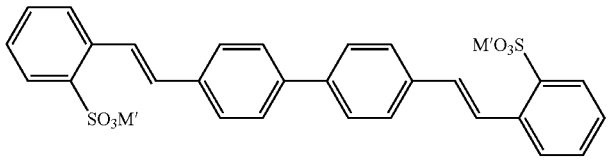

(3a)

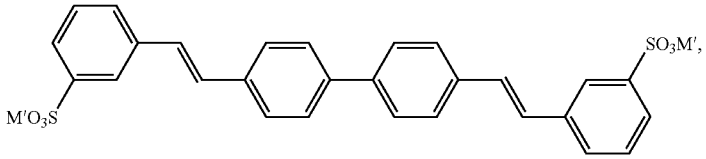

(3b)

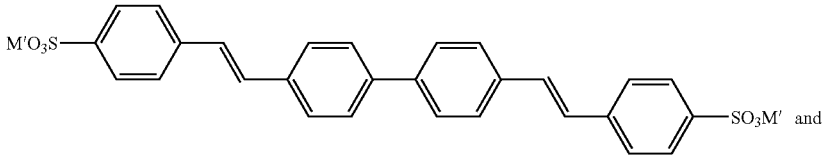

(3c)

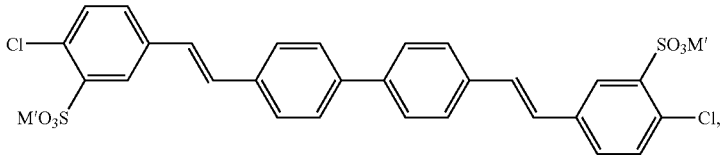

(3d)

in which

M' represents hydrogen or sodium, the compound of formula (3a) in which M' represents sodium being most preferred.

In one still further aspect, the invention relates to a detergent composition, as defined above, which additionally comprises from 0.001 to 5% by weight of a mixture of compounds of formula (2) and formula (3), as previously defined above, together with their respective preferences.

Within the scope of the above definitions, $C_1$-$C_4$alkyl may be methyl, ethyl, n- or isopropyl, n-, iso-, sec.- or t-butyl, whilst $C_1$-$C_4$alkoxy may be methoxy, ethoxy, propoxy, isopropoxy, butoxy, isobutoxy, sec.-butoxy or tert.-butoxy. $C_2$-$C_4$hydroxyalkyl may be hydroxyethyl, hydroxypropyl or hydroxybutyl, preferably hydroxyethyl or 2-hydroxypropyl and halogen may be fluorine, chlorine, bromine or iodine, preferably chlorine.

In the mixtures of compounds of formulae (1), (2) and/or (3), the molar ratio of compound (1) to compound (2) and/or (3) is usually in the range of from 0.1:99.9 to 99.9:0.1, preferably from 1:99 to 99:1 and more preferably from 5:95 to 95:5. Highly preferred is a molar ratio of from 10:90 to 90:10, especially 20:80 to 80:20. Most important is a molar ratio of from 30:70 to 70:30, especially 40:60 to 60:40.

The compounds of formulae (1), (2) and (3) are known or can be prepared in analogy to known processes.

Compounds of formula (1) can for example be prepared by first reacting cyanuric chloride with 4,4'-diaminostilbene-2,2'-disulphonic acid, then reacting the intermediate with ammonia followed by treatment with the corresponding alcohol HOR to yield the desired product.

Compounds of formula (2) may be produced by reacting, under known reaction conditions, cyanuric chloride, successively, in any desired sequence, with each of 4,4'-diaminostilbene-2,2'-disulphonic acid, aniline and amino compounds of formula $HNR_1R_2$. Preferably, 2 moles of cyanuric chloride are initially reacted with 1 mole of 4,4'-diamino-stilbene-2,2'-disulphonic acid and then reacting the intermediate obtained in any order with aniline and amino compounds of formula $HNR_1R_2$.

In general, a total amount of a compound of formula (1) or a mixture thereof together with a compound of formula (2) and/or (3) of 0.001-5%, especially an amount of 0.01-5% is used. Highly preferred is an amount of 0.05-5%, especially 0.05 to 2%. In general, amounts given in percent are to be understood as being percent by weight, based on the total weight, unless otherwise stated.

The detergent may be formulated as a solid, as an aqueous liquid comprising, e.g., 5-50, preferably 10-35% water or as a non-aqueous liquid detergent, containing not more than 5, preferably 0-1 wt. % of water, and based on a suspension of a builder in a non-ionic surfactant, as described, e.g., in GB-A-2158454.

The anionic surfactant component may be, e.g., an alkylbenzenesulphonate, an alkylsulphate, an alkylethersulphate, an olefinsulphonate, an alkanesulphonate, a fatty acid salt, an alkyl or alkenyl ether carboxylate or an α-sulphofatty acid salt or an ester thereof. Preferred are alkylbenzenesulphonates having 10 to 20 carbon atoms in the alkyl group, alkylsulphates having 8 to 18 carbon atoms, alkylethersulphates having 8 to 18 carbon atoms, and fatty acid salts being derived from palm oil or tallow and having 8 to 18 carbon atoms. The average molar number of ethylene oxide added in the alkylethersulphate is preferably 1 to 20, preferably 1 to 10. The salts are preferably derived from an alkaline metal like sodium and potassium, especially sodium. Highly preferred carboxylates are alkali metal sarcosinates of formula R—CO$(R^1)CH_2COOM^1$ in which R is alkyl or alkenyl having 9-17 carbon atoms in the alkyl or alkenyl radical, $R^1$ is $C_1$-$C_4$ alkyl and $M^1$ is alkali metal, especially sodium.

The nonionic surfactant component may be, e.g., primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The total amount of anionic surfactant and nonionic surfactant is preferably 5-50% by weight, preferably 5-40% by weight and more preferably 5-30% by weight. As to these surfactants it is preferred that the lower limit is 10% by weight.

The builder component may be an alkali metal phosphate, especially a tripolyphosphate; a carbonate or bicarbonate, especially the sodium salts thereof; a silicate or disilicate; an aluminosilicate; a polycarboxylate; a polycarboxylic acid; an organic phosphonate; or an aminoalkylene poly(alkylene phosphonate); or a mixture of these.

Preferred silicates are crystalline layered sodium silicates of the formula $NaHSi_mO_{2m+1}.pH_2O$ or $Na_2Si_mO_{2m+1}.pH_2O$ in which m is a number from 1.9 to 4 and p is 0 to 20.

Preferred aluminosilicates are the commercially-available synthetic materials designated as Zeolites A, B, X, and HS, or mixtures of these. Zeolite A is preferred.

Preferred polycarboxylates include hydroxypolycarboxylates, in particular citrates, polyacrylates and their copolymers with maleic anhydride.

Preferred polycarboxylic acids include nitrilotriacetic acid and ethylene diamine tetra-acetic acid.

Preferred organic phosphonates or aminoalkylene poly (alkylene phosphonates) are alkali metal ethane 1-hydroxy diphosphonates, nitrilo trimethylene phosphonates, ethylene diamine tetra methylene phosphonates and diethylene triamine penta methylene phosphonates.

The amount of builders is preferably 5-70% by weight, more preferably 5-60% by weight and most preferably 10-60% by weight. As to the builders it is preferred that the lower limit is 15% by weight, especially 20% by weight.

Suitable peroxide components include, for example, the organic and inorganic peroxides (like sodium peroxides) known in the literature and available commercially that bleach textile materials at conventional washing temperatures, for example at from 5 to 95° C.

In particular, the organic peroxides are, for example, monoperoxides or polyperoxides having alkyl chains of at least 3, preferably 6 to 20, carbon atoms; in particular diperoxydicarboxylates having 6 to 12 C atoms, such as diperoxyperazelates, diperoxypersebacates, diperoxyphthalates and/or diperoxydodecanedioates, especially their corresponding free acids, are of interest. It is preferred, however, to employ very active inorganic peroxides, such as persulphate, perborate and/or percarbonate. It is, of course, also possible to employ mixtures of organic and/or inorganic peroxides.

The amount of peroxide is preferably 0.5-30% by weight, more preferably 1-20% by weight and most preferably 1-15% by weight. In case a peroxide is used, the lower limit is preferably 2% by weight, especially 5% by weight.

The peroxides, especially the inorganic peroxides, are preferably activated by the inclusion of a bleach activator. Preferred are such compounds that, under perhydrolysis conditions, yield unsubstituted or substituted perbenzo- and/or peroxo-carboxylic acids having from 1 to 10 carbon atoms, especially from 2 to 4 carbon atoms. Suitable compounds include those that carry O- and/or N-acyl groups having the said number of carbon atoms and/or unsubstituted or substituted benzoyl groups. Preference is given to polyacylated alkylenediamines, especially tetraacetylethylenediamine (TAED), acylated glycolurils, especially tetraacetylglycoluril (TAGU), N,N-diacetyl-N,N-dimethyl-urea (DDU), acylated triazine derivatives, especially 1,5-diacetyl-2,4-dioxohexahydro-1,3,5-triazine (DADHT), compounds of formula

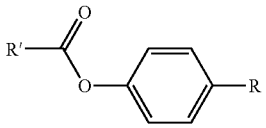

wherein R is a sulphonate group, a carboxylic acid group or a carboxylate group, and wherein R' is linear or branched ($C_7$-$C_{15}$)alkyl; also activators that are known under the names SNOBS, SLOBS, NOBS and DOBA, acylated polyhydric alcohols, especially triacetin, ethylene glycol diacetate and 2,5-diacetoxy-2,5-dihydrofuran and acetylated sorbitol and mannitol and acylated sugar derivatives, especially pentaacetylglucose (PAG), sucrose polyacetate (SUPA), pentaacetylfructose, tetraacetylxylose and octaacetyllactose, and acetylated, optionally N-alkylated, glucamine and gluconolactone. The combinations of conventional bleach activators disclosed in German Patent Application DE-A-44 43 177 may also be used. Nitrile compounds that form peroxyimidic acids with peroxides are also suitable as bleach activators. Preferred are tetraacetyl ethylenediamine and nonoyloxybenzene sulphonate.

The amount of bleach activator is preferably 0-10% by weight, more preferably 0-8% by weight. In case a bleach activator is used, the lower limit is preferably 0.5% by weight, especially 1% by weight.

Bleaching catalysts, which may be added, include, e.g., enzymatic peroxide precursors and/or metal complexes. Preferred metal complexes are manganese, cobalt or iron complexes such as manganese or iron phthalocyanines or the complexes described in EP-A-0509787. In case a bleaching catalyst is used the amount is preferably 0.005 to 2% by weight, more preferably 0.01 to 2% by weight, especially 0.05 to 2% by weight. Highly preferred is an amount of 0.1-2% by weight.

As examples for bleaching catalysts the following are mentioned:

- WO-A-95/30681 (see i.e. formula (I) and the following definition on page 1, lines 7 to 30; especially formula (I) and the following definitions given on page 2, lines 29 to page 11, line 11). Preferred ligands are those given on page 13, line 12 to page 26, line 11.
- WO-A-01/09276 (see i.e. formulae (1), (2) and (3) and the following definitions given on pages 2 and 3).
- WO-A-01/05925 (see i.e. formula (1) and the following definition on page 1, last paragraph to page 2, first paragraph. The preferences given for the metal complexes apply, see especially those of formula (2) on page 3 and those of formula (3) on page 4).
- WO-A-02/088289 (see i.e. formula (1) and the following definition on page 2. The preferences given for the metal complexes apply, see especially the ligands of formula (3) and also the preferences given on page 3, fourth paragraph to page 4, paragraph 7).

Furthermore, the detergent can optionally contain enzymes. Enzymes can be added to detergents for stain removal. The enzymes usually improve the performance on stains that are either protein- or starch-based, such as those caused by blood, milk, grass or fruit juices. Preferred enzymes are cellulases, proteases, amylases and lipases. Preferred enzymes are cellulases and proteases, especially proteases. Cellulases are enzymes which act on cellulose and its derivatives and hydrolyze them into glucose, cellobiose, cellooligosaccharide. Cellulases remove dirt and have the effect of mitigating the roughness to the touch. Examples of enzymes to be used include, but are by no means limited to, the following:

proteases as given in U.S. Pat. No. 6,242,405, column 14, lines 21 to 32;

lipases as given in U.S. Pat. No. 6,242,405, column 14, lines 33 to 46;

amylases as given in U.S. Pat. No. 6,242,405, column 14, lines 47 to 56; and cellulases as given in U.S. Pat. No. 6,242,405, column 14, lines 57 to 64.

The enzymes can optionally be present in the detergent. When used, the enzymes are usually present in an amount of 0.01-5% by weight, preferably 0.05-5% and more preferably 0.1-4% by weight, based on the total weight of the detergent.

Further preferred additives for the detergents according to the invention are polymers that, during the washing of textiles, inhibit staining caused by dyes in the washing liquor that have been released from the textiles under the washing conditions (dye fixing agents, dye transfer inhibitors). Such polymers are preferably polyvinylpyrrolidones, polyvinylimidazoles or polyvinylpyridine N-oxides which may have been modified by the incorporation of anionic or cationic substituents, especially those having a molecular weight in the range from 5000 to 60 000, more especially from 10 000 to 50 000. Such polymers are usually used in an amount of from 0.01 to 5%, preferably 0.05 to 5% by weight, especially 0.1 to 2% by weight, based on the total weight of the detergent. Preferred polymers are those given in WO-A-02/02865 (see especially page 1, last paragraph and page 2, first paragraph).

The detergents used will usually contain one or more auxiliaries such as soil suspending agents, for example sodium carboxymethylcellulose; salts for adjusting the pH, for example alkali or alkaline earth metal silicates; foam regulators, for example soap; salts for adjusting the spray drying and granulating properties, for example sodium sulphate; perfumes; and also, if appropriate, antistatic and softening agents; such as smectite clays; photobleaching agents; pigments; and/or shading agents. These constituents should, of course, be stable to any bleaching system employed. Such auxiliaries can be present in an amount of, for example, 0.1 to 20% by weight, preferably 0.5 to 10% by weight, especially 0.5 to 5% by weight, based on the total weight of the detergent.

The detergent compositions can take a variety of physical forms including powder, granular, tablet and liquid forms. Examples thereof are conventional powder heavy-duty detergents, compact and supercompact heavy-duty detergents and tablets, like heavy-duty detergent tablets. One important physical form is the so-called concentrated granular form adapted to be added to a washing machine.

Of importance are also the so-called compact (or supercompact) detergents. In the field of detergent manufacture, a trend has developed recently towards the production of compact detergents, which contain increased amounts of active substance. In order to minimize energy expenditure during the washing process, the compact detergents are required to operate efficiently at temperatures as low as 40° C., or even at room temperatures, e.g. at 25° C. Such detergents usually contain only low amounts of fillers or processing aids, like sodium sulphate or sodium chloride. The amount of such fillers is usually 0-10% by weight, preferably 0-5% by weight, especially 0-1% by weight, based on the total weight of the detergent. Such detergents usually have a bulk density of 650-1000 g/l, preferably 700-1000 g/l and especially 750-1000 g/l.

The detergents can also be present in the form of tablets. Relevant characteristics of tablets are ease of dispensing and convenience in handling. Tablets are the most compact delivery of solid detergents and have a bulk density of, for example, 0.9 to 1.3 kg/litre. To enable fast disintegration laundry detergent tablets generally contain special disintegrants:

- Effervescents such as carbonate/hydrogencarbonate/citric acid;
- swelling agents like cellulose, carboxymethyl cellulose, cross-linked poly(N-vinylpyrrollidone);
- quickly dissolving materials such as Na(K) acetate, or Na(K) citrate;
- rapidly dissolving water-soluble rigid coating such as dicarboxy acids.

The tablets can also contain combinations of any of the above disintegrants.

The detergent may also be formulated as an aqueous liquid comprising 5-50, preferably 10-35% water or as a non-aqueous liquid detergent, containing not more than 5, preferably 0-1 wt. % of water. Non-aqueous liquid detergent compositions can contain other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers. The detergents can also be present as the so-called "unit liquid dose" form.

This detergent treatment of textiles can be conducted as a domestic treatment in normal washing machines.

The textile fibres treated may be natural or synthetic fibres or mixtures thereof. Examples of natural fibres include vegetable fibres such as cotton, viscose, flax, rayon or linen, preferably cotton and animal fibres such as wool, mohair, cashmere, angora and silk, preferably wool. Synthetic fibres include polyester, polyamide and polyacrylonitrile fibres. Preferred textile fibres are cotton, polyamide and wool fibres, especially cotton fibres. Preferably, textile fibres treated according to the method of the present invention have a density of less than 200 g/m$^2$.

According to this process usually an amount of 0.01 to 3.0% by weight, especially 0.05 to 3.0% by weight, based on the weight of the textile fibre material, of a mixture of compounds of formulae (1) and (2) is used.

The process is usually conducted in the temperature range of from 5 to 100° C., especially 5 to 60° C. Preferred is a temperature range of 5 to 40° C., especially 5 to 35° C. and more preferably 5 to 30° C.

The detergent compositions herein will preferably be formulated such that, during use in aqueous cleaning operations, the wash water will have a pH of between about 6.5 and about 11, preferably between about 7.5 and 11. Laundry products are typically at pH 9-11. Techniques for controlling pH at recommended usage levels include the use of buffers, alkalis, acids, etc., and are well known to those skilled in the art.

Machine laundry methods herein typically comprise treating soiled laundry with an aqueous wash solution in a washing machine having dissolved or dispensed therein an effective amount of a machine laundry detergent composition in accordance with the invention. By an effective amount of the detergent composition it is meant, e.g., from 20 g to 300 g of product dissolved or dispersed in a wash solution of volume from 5 to 85 litres, as are typical product dosages and wash solution volumes commonly employed in conventional machine laundry methods. Examples are

- top-loading, vertical axis U.S.-type automatic washing machines using about 45 to 83 liters of water in the wash bath, a wash cycle of about 10 to about 14 minutes and a wash water temperature of about 10 to about 50° C.;
- front-loading, horizontal-axis European-type automatic washing machine using about 8 to 15 liters of water in the wash bath, a wash cycle of about 10 to about 60 minutes and a wash water temperature of about 30 to about 95° C.;
- top-loading, vertical-axis Japanese-type automatic washing machine using about 26 to 52 liters of water in the wash bath, a wash cycle of about 8 to about 15 minutes and a wash water temperature of about 5 to about 25° C.

The liquor ratio is preferably 1:4 to 1:40, especially 1:4 to 1:15. Highly preferred is a liquor ratio of 1:4 to 1:10, especially 1:5 to 1:9.

A further object of the present invention is to provide a process for the domestic washing treatment of a textile fibre material wherein the textile fibre material is contacted with an aqueous solution of a detergent comprising at least one compound of formula (1) as defined above, and wherein the detergent contains a peroxide, a peroxide activator and/or a bleaching catalyst, and wherein the temperature of the solution is between 5° C. and 40° C., preferably between 5° C. and 30° C., throughout the process.

Alternatively, the invention provides a process for the domestic washing of a textile fibre material, wherein the aqueous detergent solution contains, in addition to the compound of formula (1), at least one compound of the formula (2), as defined above, and wherein the detergent contains a peroxide, a peroxide activator and/or a bleaching catalyst, and wherein the temperature of the solution is between 5° C. and 40° C., preferably between 5° C. and 30° C., throughout the process.

In a still further alternative, the invention provides a process for the domestic washing of a textile fibre material, wherein the aqueous detergent solution contains, in addition to the compound of formula (1), at least one compound of the formula (3), as defined above, and wherein the detergent contains a peroxide, a peroxide activator and/or a bleaching catalyst, and wherein the temperature of the solution is between 5° C. and 40° C., preferably between 5° C. and 30° C., throughout the process.

As a final alternative, the invention provides a process for the domestic washing of a textile fibre material, wherein the aqueous detergent solution contains, in addition to the compound of formula (1), a mixture comprising at least one compound of the formula (2) and at least one compound of formula (3), as defined above, and wherein the detergent contains a peroxide, a peroxide activator and/or a bleaching catalyst, and wherein the temperature of the solution is between 5° C. and 40° C., preferably between 5° C. and 30° C., throughout the process.

In the course of any of the above washing processes, the textile fibre materials are treated with a total of from 0.05 to 3.0% by weight, based on the weight of textile fibre material, of the compound of formula (1), a mixture of compounds of formulae (1) and (2), a mixture of compounds of formulae (1) and (3) or a mixture of compounds of formulae (1), (2) and (3).

As to the compounds of formulae (1), (2) and (3) as well as for the detergents and the washing process, the definitions and preferences given above apply.

In a final aspect, the invention relates to a process for the fluorescent whitening of textile materials comprising contacting the textile materials with a compound of formula (1), as defined above, a mixture of compound (1) and compound (2), as defined above, a mixture of compound (1) and compound (3), as defined above, or a mixture of compounds (1), (2) and (3).

The compounds used for the compositions and processes according to the present invention are particularly advantageous in that they exhibit not only extremely high whitening ability, but, in addition, in many cases highly desirable water solubilities and also possess excellent white aspects in the solid state. A further advantage of the present invention is that the detergent composition delivers improved whiteness performance and fabric feel. Furthermore the compounds show very good results with respect to exhaustion properties.

The compounds have the advantage that they are also effective in the presence of active chlorine donors, such as, for example, hypochlorite and can be used without substantial loss of the effects in washing baths with non-ionic washing agents, for example alkylphenol polyglycol ethers. Also in the presence of perborate or peracids and activators, for example tetraacetylglycoluril or ethylenediamine-tetraacetic acid are the compounds stable both in pulverulent washing agent and in washing baths. In addition, they impart a brilliant appearance in daylight.

The following Examples serve to illustrate the invention; parts and percentages are by weight, unless otherwise stated.

A. PREPARATIVE EXAMPLES

Example 1

(101)

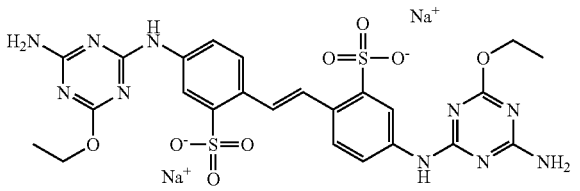

A solution of 43 g of 4,4'-diaminostilbene-2,2'-disulphonic acid in 400 ml of water is added to a mixture consisting of 260 g of methyl ethyl ketone, 225 g of ice and 45 g of cyanuric chloride with stirring. During the addition, the reaction temperature is maintained at below 10° C. by external cooling and the pH maintained at between 4.5 and 5.0 by addition of 15% aqueous sodium carbonate solution. After warming to 30° C., 25.5 ml of a 24.9% aqueous ammonia solution is added within 3 minutes and the pH adjusted to between 9.0 and 9.3 by addition of 40% aqueous sodium hydroxide solution. The mixture is then stirred for 3 hours at a temperature of between 36 and 39° C. and then heated to 55° C. The pH of the mixture is then adjusted to between 6.9 and 7.3 by addition of 35% aqueous hydrochloric acid and the temperature raised to 98° C., whereby 350 ml of a methyl ethyl ketone/water mixture distils off. After cooling to 20° C., the precipitated solids are filtered, whereby 115.4 g of moist filter cake containing bis-(2-amino-4-chloro-1,3,5-triazin-6-yl)aminostilbene-2,2'-disulphonic acid are obtained.

38 g of the moist filter cake are added to a mixture of 6.5 g of sodium hydroxide and 500 ml of ethanol at 70° C. with stirring. After cooling to room temperature, the precipitated solids are filtered, washed with ethanol, then with 12.5% aqueous sodium chloride and dried under vacuum at 60° C. There are obtained 28.8 g of the compound of formula (101) as yellow crystals.

Example 2

By following the procedure of Example 1, but replacing the 500 ml of ethanol by 500 ml of methanol, the compound of formula (102) is obtained.

(102)

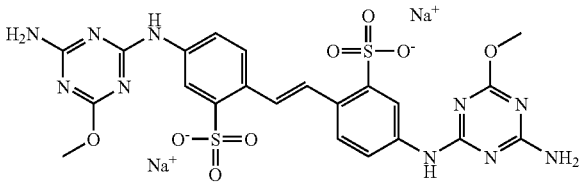

B. Application Examples

Example 3

An ECE standard laundry test detergent composition according to Table 1 is prepared.

TABLE 1

| | |
|---|---|
| Linear sodium alkyl benzene sulphonate (average C chain: 11.5) | 9.7% |
| Fatty alcohol ethoxylate $C_{12}$-$C_{15}$ with 7 moles ethylene oxide | 5.2% |
| Sodium soap (chain length: 46% $C_{12-17}$; 54% $C_{18-20}$) | 3.6% |
| Antifoam | 4.5% |
| Sodium aluminium silicate (Zeolite 4A) | 32.5% |
| Sodium carbonate | 11.8% |
| Sodium salt of acrylic acid/maleic acid copolymer | 5.2% |
| Sodium silicate | 3.4% |
| Carboxymethylcellulose | 1.3% |
| Diethylene triamine pentamethyl phosphonic acid | 0.8% |
| Sodium sulphate | 9.8% |
| Water | 12.2% |

To this composition, 15% sodium percarbonate and 5% tetraacetyl ethylene diamine (TAED) are added, followed by sufficient of the appropriate fluorescent whitening agent (FWA) such that 64 μmoles of FWA/kg of fabric detergent is present in the composition.

A bleached cotton fabric is then washed using 40 g of the detergent composition/kg of fabric at a liquor ratio of 10:1 in water of 10° German hardness at 20° C. during 15 minutes and dried under outdoor conditions, i.e. with exposure to UV radiation.

After 3 washing and drying cycles, the Ganz whiteness values of the cotton are measured. The results are summarized in the following Table 2:

TABLE 2

| FWA | Ganz Whiteness |
|---|---|
| Compound (102) | 166 |
| Tinopal ® DMA-X[1] | 148 |

Note[1]:
A commercial detergent FWA available from Ciba Specialty Chemicals

Examples 4-5

A laundry detergent powder is prepared containing the ingredients indicated in Table 3.

TABLE 3

| | |
|---|---|
| Alkyl benzene sulphonate | 15.7% |
| Fatty alcohol sulphonate | 3.7% |
| Coconut acid monoethanolamide | 2.7% |
| Sodium tripolyphosphate | 39.0% |
| Sodium silicate | 4.0% |
| Magnesium silicate | 2.0% |
| Carboxymethylcellulose | 1.0% |
| Sodium ethylene diamine tetraacetate (EDTA) | 0.5% |
| Water | 6.7% |
| Sodium sulphate | 24.7% |

To this composition, sufficient of the appropriate fluorescent whitening agent (FWA) is added such that 64 μmoles of FWA/kg of fabric detergent is present in the composition.

A bleached cotton fabric is then washed using 40 g of the detergent composition/kg of fabric at a liquor ratio of 10:1 in water of 10° German hardness at 20° C. during 15 minutes and dried under outdoor conditions, i.e. with exposure to UV radiation.

After 3 washing and drying cycles, the Ganz whiteness values of the cotton are measured. The results are summarized in the following Table 4:

TABLE 4

| Example No. | FWA | Ganz Whiteness |
|---|---|---|
| 4 | Compound (102) | 175 |
| 5 | Compound (101) | 170 |
| Comparison | Tinopal ® DMA-X | 156 |

In all cases, the improved whiteness of the washed fabric using the compositions of the invention, in comparison to that containing the commercially available product is clearly evident.

The invention claimed is:

1. A detergent composition comprising i) 1-70% of an anionic or nonionic surfactant, ii) 1-75% of a builder, iii) 0.001-5% of at least one compound of the formula (1)

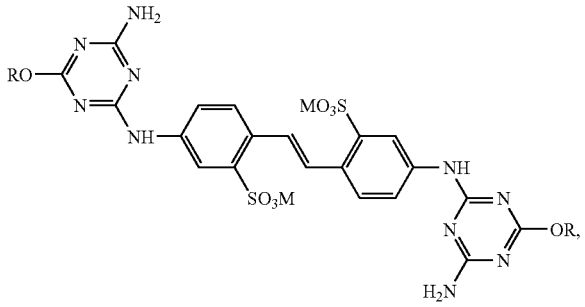

wherein,

R represents a $C_1$-$C_4$alkyl residue and

M represents hydrogen or an alkali metal cation, iv) 0-30% of a peroxide, v) 0-10% of a peroxide activator, vi) 0-5% of a bleaching catalyst and vii) 0-5% of an enzyme, each component by weight, based on the total weight of the detergent composition.

2. A detergent composition according to claim 1, which additionally comprises from 0.001 to 5% by weight of at least one compound of the formula (2)

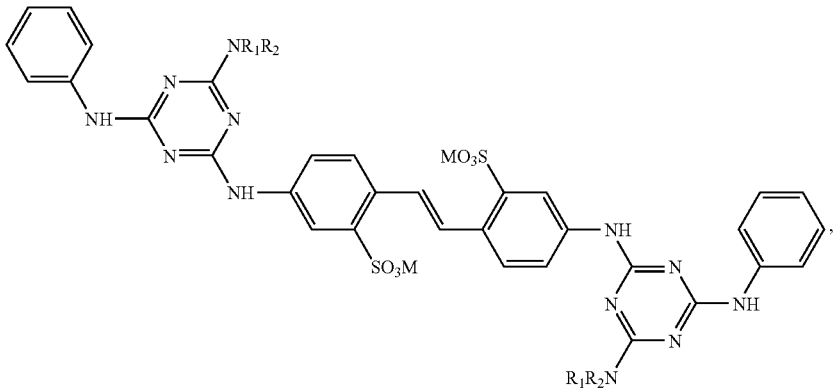

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation.

3. A detergent composition according to claim 1, which additionally comprises from 0.001 to 5% by weight of at least one compound of the formula (3)

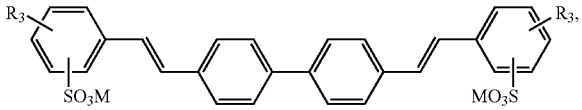

wherein $R_3$ represents hydrogen, $C_1$-$C_4$alkyl, $C_1$-$C_4$alkoxy or halogen and M represents hydrogen or an alkali metal cation.

4. A detergent composition according to claim 1, which additionally comprises from 0.001 to 5% by weight of a mixture of compounds of formula (2)

(2)

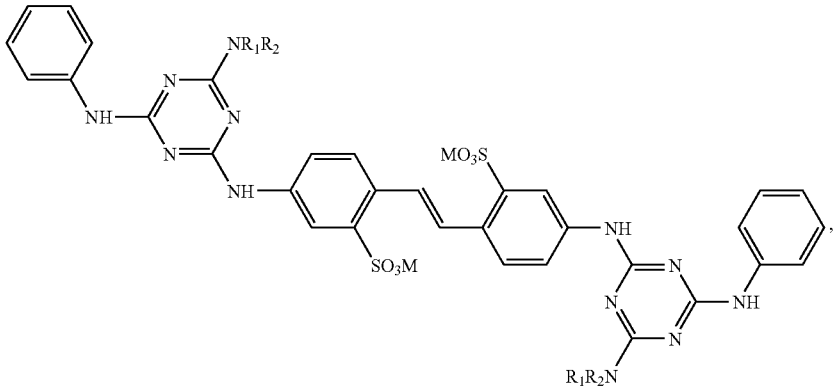

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation and formula (3)

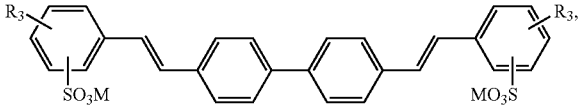

wherein $R_3$ represents hydrogen, $C_1$-$C_4$, $C_1$-$C_4$alkoxy or halogen and M represents hydrogen or an alkali metal cation.

5. A detergent composition according to claim 1, in which, in the compound of formula (1)

R represents methyl or ethyl and

M represents hydrogen, lithium or sodium.

6. A detergent composition according to claim 2, in which, in the compound of formula (2)

$R_1$ represents hydrogen, methyl, ethyl, hydroxyethyl or hydroxypropyl, $R_2$ represents methyl, ethyl, hyroxyethyl, hyroxypropyl or phenyl, or $R_1$ and $R_2$, together with the nitrogen atom, complete a morpholino ring and M represents hydrogen or sodium.

7. A detergent composition according to claim 3, in which the compound of formula (3) is selected from the compounds of formulae (1)

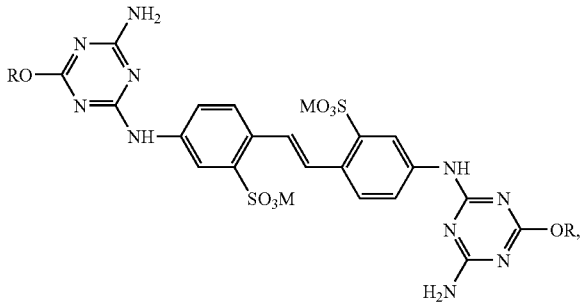

(3a)

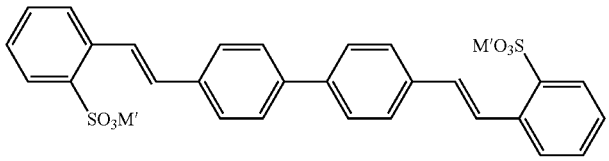

(3b)

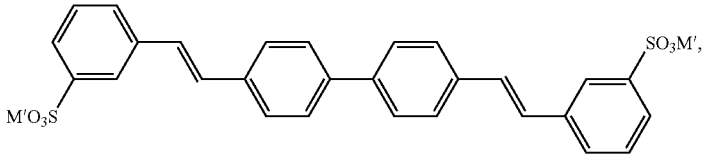

(3c)

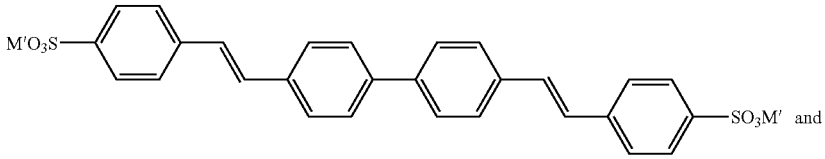

and (3d)

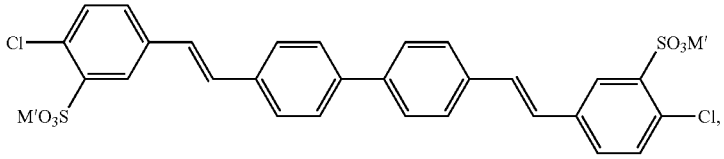

in which

M' represents hydrogen or sodium.

8. A process for the domestic washing treatment of a textile fibre material wherein the textile fibre material is contacted with an aqueous solution of a detergent comprising at least one compound of the formula wherein, R represents a $C_1$-$C_4$alkyl residue and M represents hydrogen or an alkali metal cation and wherein the detergent contains a peroxide, a peroxide activator and/or a bleaching catalyst and wherein the temperature of the solution is between 5 and 40° C. throughout the process.

9. A process according to claim 8, wherein the aqueous detergent solution contains, in addition to the compound of formula (1), at least one compound of the formula (2)

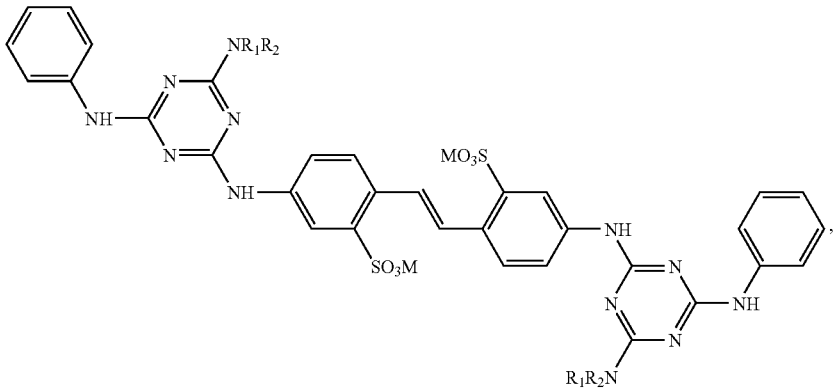

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation.

10. A process according to claim 8, wherein the aqueous detergent solution contains, in addition to the compound of formula (1), at least one compound of the formula (3)

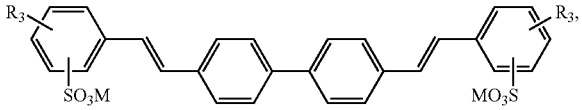

wherein $R_3$ represents hydrogen, $C_1$-$C_4$alkyl, $C_1$-$C_4$alkoxy or halogen and M represents hydrogen or an alkali metal cation.

11. A process according to claim 8, wherein the aqueous detergent solution contains, in addition to the compound of formula (1), a mixture of compounds comprising at least one compound of formulae (2)

(2)

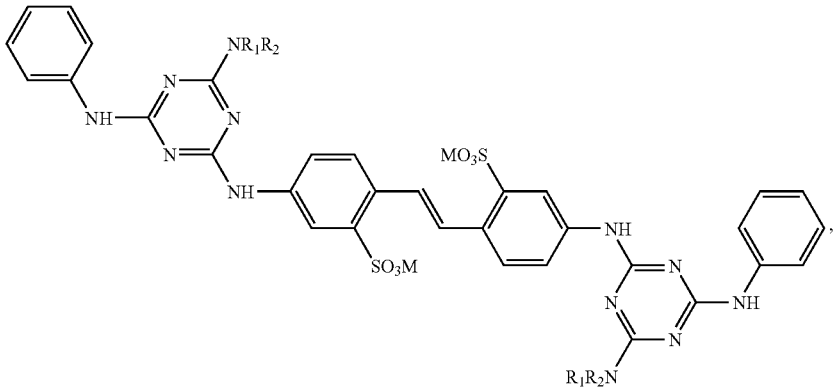

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation and at least one compound of formula (3)

(3)

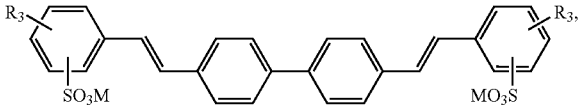

wherein $R_3$ represents hydrogen, $C_1$-$C_4$alkyl, $C_1$-$C_4$alkoxy or halogen and M represents hydrogen or an alkali metal cation.

12. A process according to claim 8, wherein the textile fibre materials are treated with a total of from 0.05 to 3.0% by weight, based on the weight of textile fibre material, of the compound of formula (1), a mixture of compounds of formulae (1) and (2), (2)

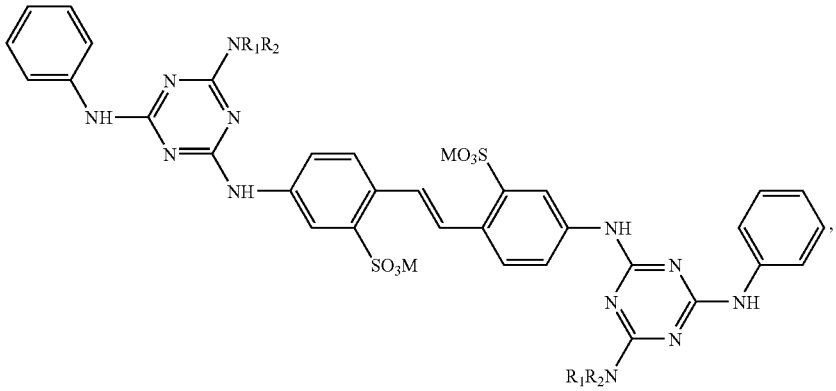

wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation a mixture of compounds of formulae (1) and (3)

(3)

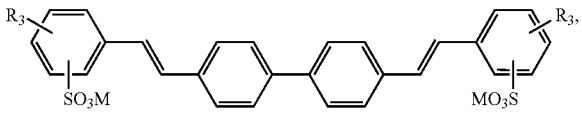

wherein $R_3$ represents hydrogen, $C_1$-$C_4$alkyl, $C_1$-$C_4$alkoxy or halogen and M represents hydrogen or an alkali metal cation or a mixture of compounds of formulae (1), (2) and (3).

13. A process for the fluorescent whitening of textile materials comprising contacting the textile materials with a compound of formula (1), as defined in claim 1, a mixture of compound (1) and compound (2), wherein $R_1$ and $R_2$ each independently represent hydrogen, $C_1$-$C_4$alkyl, $C_2$-$C_4$hydroxyalkyl, unsubstituted or substituted phenyl or, together with the nitrogen atom, complete a morpholino, piperidino or pyrrolidino ring and M represents hydrogen or an alkali metal cation a mixture of compound (1) and compound (3), (3)

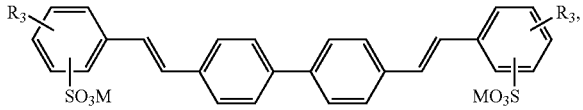

wherein $R_3$ represents hydrogen, $C_1$-$C_4$alkyl, $C_1$-$C_4$alkoxy or halogen and M represents hydrogen or an alkali metal cation.

or a mixture of compounds (1), (2) and (3).

(2)

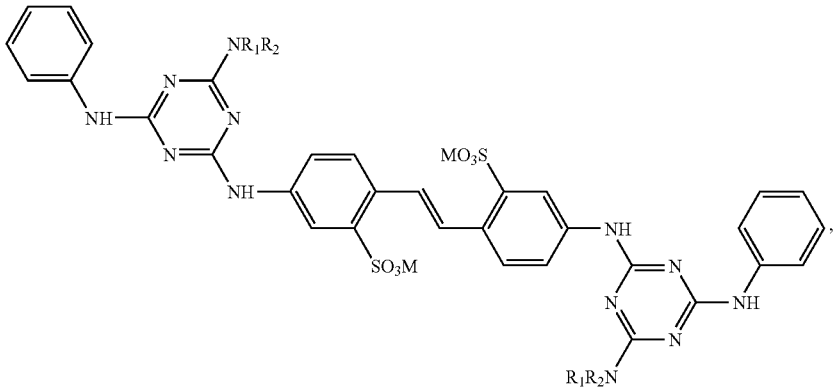

* * * * *